US008350723B2

(12) United States Patent
Serex

(10) Patent No.: US 8,350,723 B2
(45) Date of Patent: Jan. 8, 2013

(54) METHOD AND SYSTEM FOR IMPROVED TRAFFIC SIGNAGE

(75) Inventor: Patrick Serex, Geneva (CH)

(73) Assignee: Guesswhat, LLC, Menlo Park, CA (US)

( * ) Notice: Subject to any disclaimer, the term of this patent is extended or adjusted under 35 U.S.C. 154(b) by 305 days.

(21) Appl. No.: 12/696,844

(22) Filed: Jan. 29, 2010

(65) Prior Publication Data

US 2011/0187558 A1 Aug. 4, 2011

(51) Int. Cl.
*G08G 1/09* (2006.01)

(52) U.S. Cl. ..... 340/905; 340/572.1

(58) Field of Classification Search ..... 340/905, 340/572.1–572.8
See application file for complete search history.

(56) References Cited

U.S. PATENT DOCUMENTS

| | | | | |
|---|---|---|---|---|
| 5,412,381 | A * | 5/1995 | Dicks | 340/908.1 |
| 6,515,596 | B2 * | 2/2003 | Awada | 340/905 |
| 6,747,574 | B2 * | 6/2004 | Butzer et al. | 340/907 |
| 6,864,784 | B1 * | 3/2005 | Loeb | 340/441 |
| 7,272,502 | B2 * | 9/2007 | Lee et al. | 701/472 |
| 7,273,328 | B2 * | 9/2007 | Hunter et al. | 404/12 |
| 7,397,390 | B2 * | 7/2008 | DiPiazza | 340/905 |
| 7,427,928 | B2 * | 9/2008 | Crocker et al. | 340/902 |
| 7,859,428 | B2 * | 12/2010 | Boss et al. | 340/905 |
| 8,060,308 | B2 * | 11/2011 | Breed | 702/3 |
| 2008/0106436 | A1 * | 5/2008 | Breed | 340/905 |
| 2008/0218379 | A1 * | 9/2008 | Boss et al. | 340/905 |
| 2008/0243350 | A1 * | 10/2008 | Harkness | 701/93 |

FOREIGN PATENT DOCUMENTS

| | | | |
|---|---|---|---|
| KR | 19980061443 | A | 10/1998 |
| KR | 0156556 | B1 | 12/1998 |
| KR | 20050029541 | A | 3/2005 |
| KR | 100513946 | B1 | 9/2005 |

OTHER PUBLICATIONS

International Search Report mailed Oct. 31, 2011 for PCT Application No. PCT/US2011/000173.
Written Opinion mailed Oct. 31, 2011 for PCT Application No. PCT/US2011/000173.

* cited by examiner

*Primary Examiner* — Eric M Blount
(74) *Attorney, Agent, or Firm* — Perkins Coie LLP

(57) ABSTRACT

An improved traffic sign is discussed. The traffic sign includes an RFID tag configured to transmit a traffic information to a vehicle-mounted receiver. The traffic information can be associated with a priority. The receiver can be in communication with a vehicle-mounted display, wherein the display displays information selected from received traffic information based on priority, time of receipt, and relevance.

24 Claims, 5 Drawing Sheets

METHOD AND SYSTEM FOR IMPROVED TRAFFIC SIGNAGE

BACKGROUND

Many countries have extensive road and highway systems allowing individuals to drive from one point to another. The road and highway systems can support moving vehicles such as cars, sedans, trucks, and motorcycles.

Traffic signs or road signs are signs erected at the side of roads to provide traffic information to drivers. For example, freeways and streets can have traffic signs that provide directions, street names, speed limits, and other information of interest to drivers. Traffic signs can also include road reflectors, which reflect available light towards a driver indicating road lane divisions.

Vehicle speed represents an important safety factor for all drivers on a road and highway system. Different roads and different portions of a road can have different suitable speed limits. The suitable speed limit can differ based on traffic conditions, local weather, constructions, police activity, accident, and other factors. Furthermore, the suitable speed limit can differ based on a vehicle class, for example, a higher speed limit can apply to a sedan while a lower speed limit can apply to a truck or a vehicle towing another vehicle.

Drivers can be informed of applicable speed limits through traffic signs depicting speed limit information. Speed limit signs can be permanently installed near the road to be visible to drivers on the roadway. Speed limit signs can also be dynamic, utilizing light bulbs, LEDs, or other devices to display a specified speed limit. Furthermore, speed limit signs can be temporary, and placed by construction crews around construction zones or by police around accident sites.

To help drivers comply with applicable speed limits, vehicles typically have speedometer, such as an analog gauge, digital display, or another output device indicating a current speed of the vehicle. It is the responsibility of the driver to notice speed limit signs and adjust vehicle speed accordingly.

Unfortunately, observing the applicable speed limit can be burdensome on a driver. For example, speed limit signs can be missed if the driver's attention wavers or if a large vehicle obstructs the driver's view of the speed limit sign. Speed limit signs can also be missed as the driver handles immediate traffic situations that affect safety, such as avoid road obstructions. The driver's attention on the vehicle speedometer can waver for other reasons.

Existing traffic signs are passive, requiring a driver's active attention to convey information. If the driver's attention is focused elsewhere or wavers, the traffic sign can be missed. This is a particular problem on freeways, where vehicles travel quickly and a traffic sign is visible only briefly.

Thus, an improved method and system for providing traffic signage is needed.

DETAILED DESCRIPTION

Figure 1:
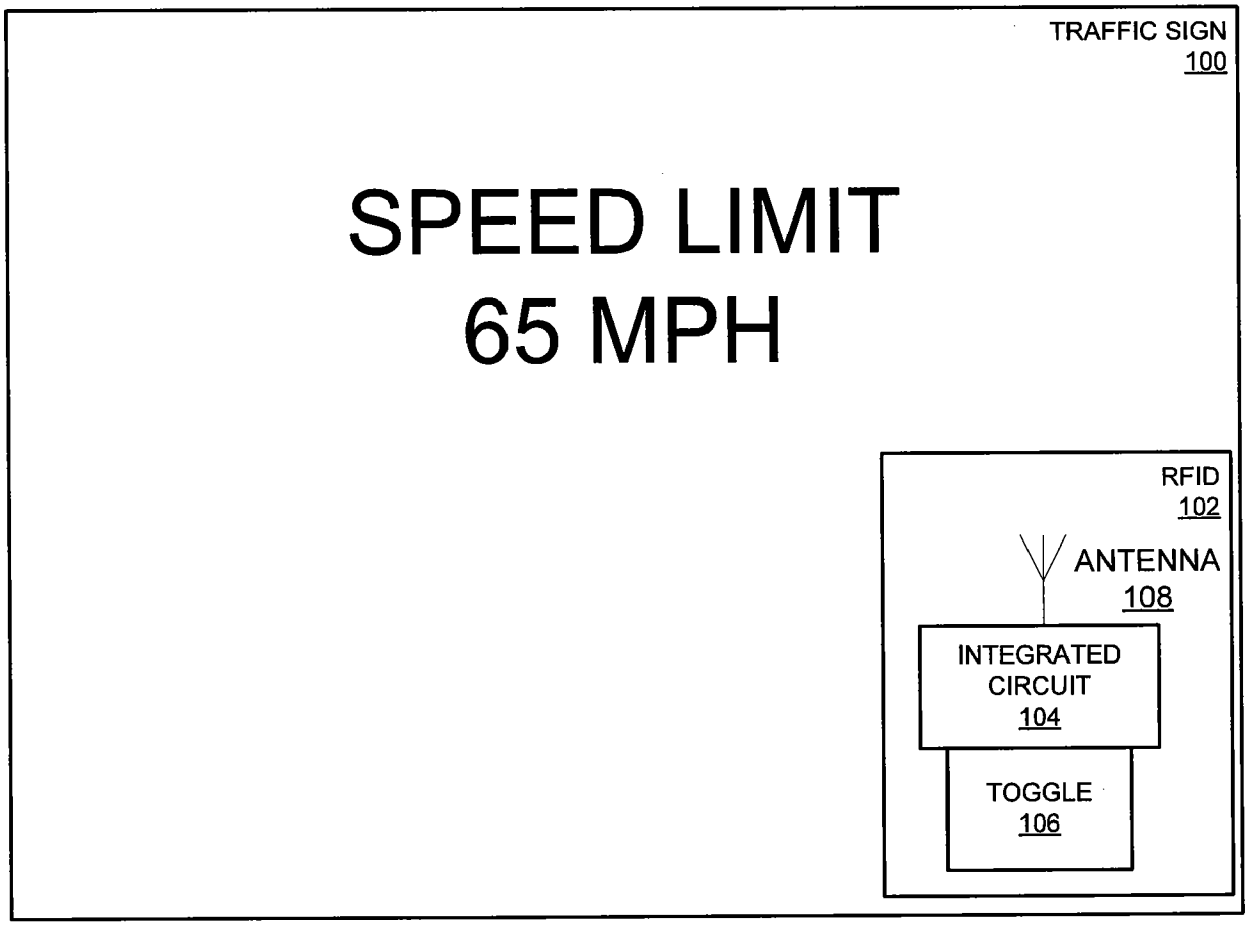
FIG. 1 illustrates an example traffic sign incorporating an RFID tag.

Improved traffic signs are provided, whereby traffic information such as an applicable speed limit is provided to a vehicle-mounted receiver. The receiver then displays relevant traffic information to a driver as appropriate. Each speed limit can be associated with a priority, and high priority speed limits can be implemented with mobile traffic signs as necessary, overriding regular priority speed limits. Other traffic information can also be provided. It will be appreciated that alternative embodiments can provide information other than traffic information, such as advertising.

In one embodiment, traffic information is transmitted by RFID tags installed along a road, for example, near existing traffic signs. Mobile traffic signs can also be equipped with RFID tags configured to transmit high-priority speed limit information, for example, for use near a construction zone or accident site. It will be appreciated that the traffic information transmitted by the RFID tag can be static or dynamic. For example, passive RFID tags can be configured to provide static information. In contrast, semi-active and active RFID tags can be configured to provide dynamic information. Such tags can be used in conjunction or in place of existing dynamic traffic signs, for example, light bulb or LED equipped traffic signs connected with a control center for displaying dynamically controlled speed limits.

It will be appreciated that radio-frequency identification (RFID) is the use of an object (typically referred to as an RFID tag) applied to or incorporated into a product, animal, or person for the purpose of identification and tracking using radio waves. RFID tags can be read at a distance with an RFID receiver.

Most RFID tags contain two parts. A first part includes an integrated circuit for storing and processing information, modulating and demodulating a radio-frequency (RF) signal, and other specialized functions. A second part includes an antenna for receiving and transmitting the signal. It will be appreciated that multiple antennas can be incorporated into an RFID tag. For example, a passive RFID tag can include a first antenna configured to receive an RF activation signal and converting the activation signal into energy to power the RFID tag. The passive RFID tag can include a second antenna configured to transmit the information associated with the RFID tag.

There are three general types of RFID tags: active RFID tags, which contain a battery and can transmit signals autonomously; passive RFID tags, which have no battery and require an external source to provoke signal transmission; and battery assisted passive (BAP) or semi-active tags which require an external source to wake up but transmit with the assistance of the battery and have higher read or transmission ranges compared to passive RFID tags.

An RFID receiver can transmit a signal to nearby RFID tags for information. The active RFID tag transmits a self-powered response signal. The battery assisted passive RFID tag is initialized by the receiver signal and transmits a self-powered response signal. The passive RFID tag converts the receiver signal into power which is used to transmit a response signal.

RFID tags can be manufactured cheaply and are therefore well-suited to applications requiring a large number of units to be distributed or installed.

The visible spectrum is the portion of the electromagnetic spectrum that is visible to (can be detected by) the human eye.

Electromagnetic radiation in this range of wavelengths is called visible light or simply light. A typical human eye will respond to wavelengths from about 380 to 750 nm or 790-400 terahertz. Non-visible light can be electromagnetic radiation outside the visible spectrum.

In another embodiment, traffic information can be conveyed by polarized non-visible light reflectors installed along a road. A vehicle-mounted non-visible light source projects a non-visible light, and a vehicle-mounted non-visible light receiver detects any reflected light. The reflectors can be polarized to convey information, for example, a speed limit. A vehicle-mounted sensor can detect the reflected light along with any polarized regions within the reflected light.

It will be appreciated that polarization is a property of some waves describing the orientation of the waves' oscillations. Waves such as light, along with other types of waves, exhibit polarization. The polarization of light is described by specifying the direction of the wave's electric field. When light travels in free space, in most cases it propagates as a transverse wave—the polarization is perpendicular to the wave's direction of travel. In this case, the electric field may be oriented in a single direction (linear polarization), or it may rotate as the wave travels (circular or elliptical polarization). In the latter cases, the oscillations can rotate rightward or leftward in the direction of travel, and which of those two rotations is present in a wave is called the wave's handedness.

FIG. 1 illustrates an example traffic sign incorporating an RFID tag. As discussed above, the traffic sign includes RFID functionality to transmit a response signal including a traffic information to a vehicle-mounted receiver.

In one embodiment, a traffic sign 100 can include a visible portion depicting traffic information to drivers along a road. The traffic information can be depicted in accordance with local laws and conventions. In one embodiment, existing traffic signs can be retrofitted with an RFID tag (discussed below) to provide RFID traffic information functionality.

The traffic sign can include a RFID tag 102. For example, the RFID tag 102 can be a passive device, as discussed. Passive RFID tags have the advantage of reliability, simplicity, low-cost, and low-maintenance. Such tags can be installed in large numbers along road or other areas of operation for vehicles, making traffic information widely available to vehicles equipped with transmitters and receivers, discussed below.

It will be appreciated that the traffic sign 100 can be constructed from a non-metallic or non-conductive material so as not to interfere with the operations of the RFID tag 102. Alternatively, the RFID tag 102 can be disposed around or in conjunction with the traffic sign 100 in such a way that the traffic sign 100 does not interfere with its transmissions.

The RFID tag 102 can include an integrated circuit 104. The integrated circuit 104 can include a memory storing traffic information to be transmitted on request. For example, the traffic information can be an identifier for use in a look-up table located at the receiving end, wherein each identifier corresponds to a traffic information.

The integrated circuit 104 can also include logic for processing information, if necessary. For example, security and authentication safeguards may be put in place. In another example, each passing vehicle can transmit a vehicle identifier or a vehicle class identifier, which can affect the traffic information transmitted. For example, trucks can have a lower speed limit than cars. Trucks would transmit a truck class identifier and receive a truck speed limit, while cars would transmit a car class identifier and receive a car speed limit.

In another embodiment, the integrated circuit 104 can broadcast traffic information for various classes of vehicles, each class associated with different applicable traffic information. In this embodiment, a receiver receiving the traffic information would be programmed with a vehicle class of the vehicle it is installed in and logic to display the appropriate traffic information for the vehicle class.

In one embodiment, the receiver is permanently installed in the vehicle at manufacture or at a later time, and can be permanently programmed with the vehicle class and other information. In another embodiment, the receiver can include a user interface receiving a vehicle class from a user. For example, the receiver can be integrated into a portable unit that can be moved from vehicle to vehicle.

The RFID tag 102 can include a toggle 106. The toggle 106 can allow an operator to set a traffic information to be transmitted. Multiple traffic information can be stored in the integrated circuit 104 above, and the toggle 106 switches the active traffic information for transmission. For example, a congested traffic condition or poor weather conditions can make a slower speed limit appropriate. In one embodiment, active and semi-active RFID tags can be equipped with toggle 106. Passive RFID tags can have the toggle 106 eliminated to reduce cost and complexity.

The toggle 106 can be a switch allowing an operator to select a traffic information for transmission. In one example, the toggle 106 can be radio activated. In this example, an operator can drive by the traffic sign 100 with an active radio transmitter and set the desired traffic information.

In another embodiment, the traffic sign 100 can be in communication with a network, over which the toggle 106 can be manipulated.

The RFID tag 102 can include an antenna 108. The antenna 108 can be for receiving a request signal from a passing vehicle-mounted transmitter. The antenna 108 can also be for transmitting the traffic information when requested.

In one embodiment, the traffic sign 100 can include just the RFID tag 102 without any visible portion. In this embodiment, a plurality of RFID tags can be installed along a road providing speed limit information to passing vehicles. It will be appreciated that the combined visible sign and RFID tag speed limit sign discussed above can be used during a transition phase to a pure RFID speed limit system.

It will be appreciated that the RFID tag 102 can be integrated into the traffic sign 100. For example, the antenna 108 can be coiled around the perimeter of a non-metallic traffic sign 100.

Figure 2:
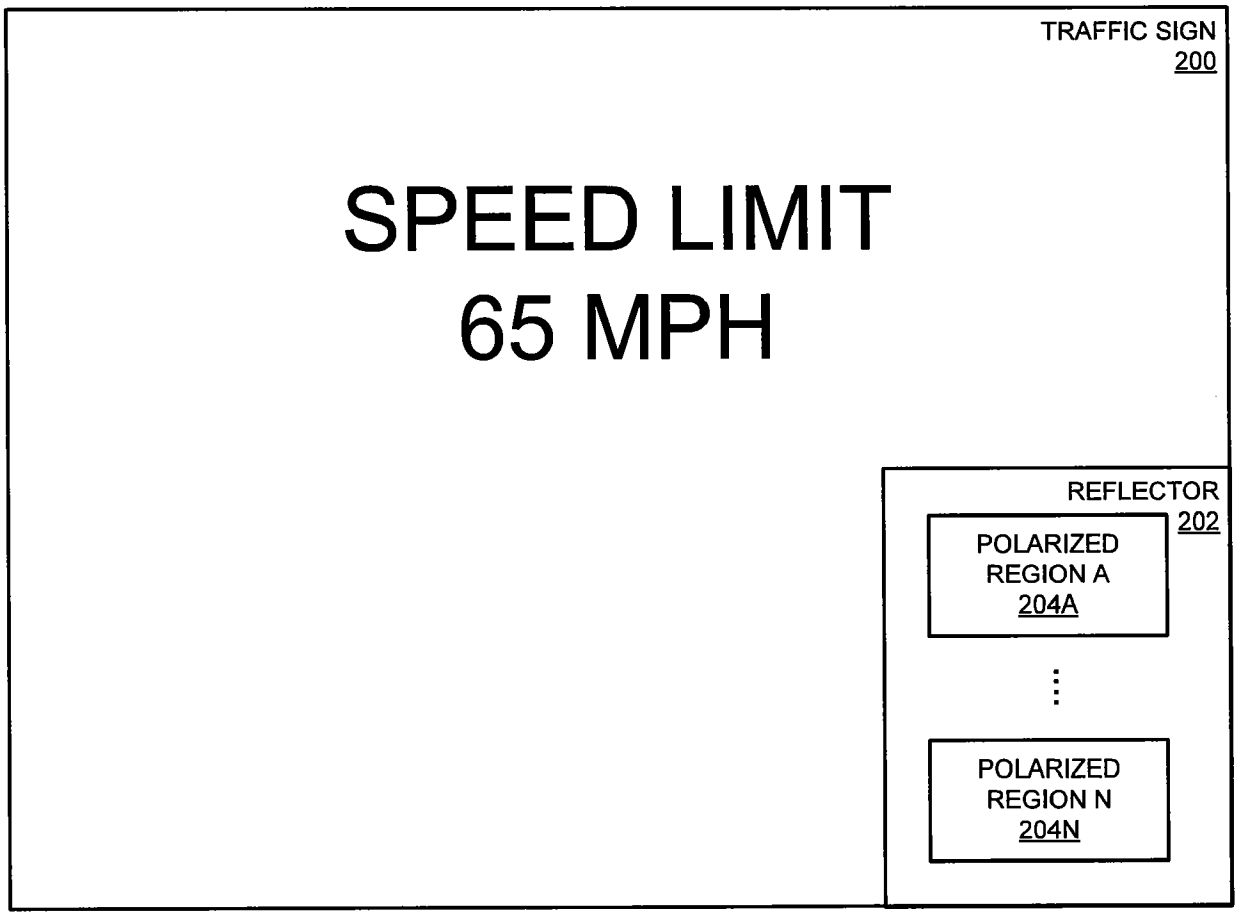
FIG. 2 illustrates an example traffic sign incorporating a non-visible polarized tag.

FIG. 2 illustrates an example traffic sign incorporating a non-visible polarized tag. A traffic sign 200 can be similar to the RFID traffic sign discussed above, including a visible portion depicting traffic information to the driver.

The traffic sign 200 can include a reflector 202. The reflector 202 can be configured to reflect non-visible light in a polarized manner, wherein the polarization of the reflection is configured to convey information.

In one embodiment, a regular road reflector is treated to polarize reflected light. It will be appreciated that a variety of polarization standards can be used to convey information.

In one embodiment, the reflector 202 can be optimized to reflect ambient non-visible light towards an oncoming vehicle. In another embodiment, the reflector 202 can be optimized to reflect non-visible light projected by vehicle headlights towards an oncoming vehicle. In another embodiment, the reflector 202 can be optimized to reflect non-visible light projected by a non-visible light source towards an oncoming vehicle.

The reflector 202 includes a one or more polarized regions A . . . N 204A to 204N. For example, each polarization region can be polarized in a different manner, which allows the reflection to convey information. For example, a set number of polarization regions can be defined for traffic signs, and the polarization regions can be either active or inactive. The reflection would include such polarized regions, which can be interpreted as a binary word.

In one embodiment, the polarized regions can be switched on and off via mechanical or other means. In this embodiment, the traffic information conveyed in the reflection can be changed. For example, the traffic information can be changed by an operator as discussed above.

In another embodiment, the polarized regions 204 can reflect an oncoming beam of non-visible, non-polarized light as a non-visible, polarized light of a specific polarization angle.

Figure 3:
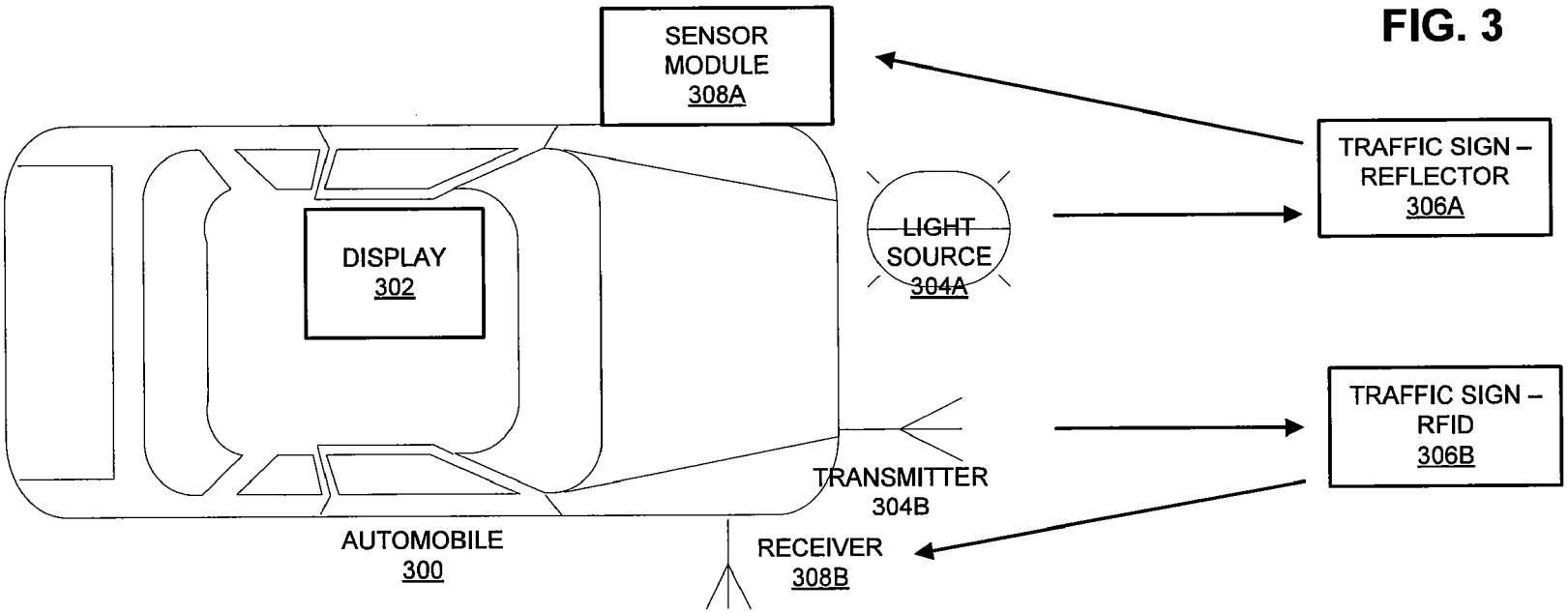
FIG. 3 illustrates an example system of improved road signs.

FIG. 3 illustrates an example system of improved road signs. The system can include existing traffic infrastructure such as roads, traffic signs, etc. along with newly added elements, discussed below. Such a system of improved road signs increase driver awareness of relevant traffic information while driving and improve distribution of traffic information.

The system can include an automobile 300. For example, the automobile 300 can be a passenger sedan operated by a driver for movement along a road and highway system.

It will be appreciated that any vehicle capable of moving along the roads as discussed herein can be modified in a similar manner to the automobile 300.

The automobile 300 can include a vehicle-mounted display 302. The display 302 can be configured to display traffic information as discussed herein. The display 302 can be mounted in a driver-viewable location within the automobile 300, such as integrated into the dashboard or windshield. In one embodiment, the display 302 can be a projection system for projecting traffic information onto the windshield in a non-obtrusive but visible manner. In another embodiment, the display 302 can be a LCD or similar screen viewable by the driver.

If no traffic information is present, the display 302 can display an error message such as "no traffic information found" or a notification message such as "check speed limit". For example, traffic information could have been missed from the local transmitter, or an area may not yet have improved traffic signs installed.

The automobile 300 can include a non-visible light source 304A. The non-visible light source 304A can be mounted in any of a plurality of locations on the automobile 300. For example, the non-visible light source 304A can be mounted proximate to the headlights, underneath the chassis, or some other location.

The non-visible light source 304A can be configured to project a non-visible light forward of the automobile 300. The non-visible light source 304A can be optimized for creating reflections off reflectors. For example, the non-visible light source 304A can be angled downwards to create reflections off, reflectors installed on the road surface. Alternatively, the non-visible light source 304A can be angled forward to create reflections off reflectors installed on traffic signs.

It will be appreciated that reflectors can be installed in a variety of places along a road. Reflectors to inform the automobile 300 where to focus the light source 304A for an upcoming stretch of road via traffic information.

The system can include a reflector traffic sign 306A. The reflector traffic sign 306A can be configured to reflect polarized non-visible light back towards the automobile 300 while the automobile 300 is in motion, as discussed above. In one embodiment, the reflector traffic sign 306A can reflect non-visible polarized to a specified or predetermined angle.

The automobile 300 can include a sensor module 308A. The sensor module 308 can include a non-visible light detector for detecting the reflection and logic circuits for processing the detected reflection. For example, the sensor module 308 can convert the polarized reflection into a binary word, wherein each polarization region discussed above is converted into a single bit. The sensor module 308 can also include a look-up table for converting the binary word into a traffic information. In one embodiment, the sensor module 308A can interpret repetitive presence of light polarized to a predetermined angle discussed above as a valid traffic information.

The non-visible light detector can be mounted outside the automobile 300 to detect the reflection. The logic can be installed inside the automobile 300, for example, integrated with the automobile 300's onboard computer.

In another embodiment, the light source 304A can emit a non-visible non-polarized light beam, to be reflected off reflector 306A. The reflector 306A can reflected non-visible light but polarized at a specific angle. In this embodiment, the non-visible detector can detect non-visible light of various polarization angles, and is therefore able to determine when light is reflected by the reflector 306A. The presence or absence of specified polarization angles in the reflected light can convey traffic information to the sensor module 308A.

The automobile 300 can include a transmitter 304B. In a system with RFID tags as discussed above, the transmitter 304B can transmit a request signal towards one or more proximate RFID traffic signs 306B. The request signal can supply power to a passive RFID tag, or simply wake up a BPA and an active RFID tag.

Passive RFID tags can be useful in remote regions, while active and semi-active RFID tags can be appropriate for locations already wired for power, such as current dynamic electric speed limit signs.

The system can include a RFID traffic sign 306B. The RFID traffic sign 306B can be a traffic sign equipped with a RFID tag, as discussed above. In one embodiment, the RFID traffic signs 306B incorporate passive RFID tags. In another embodiment, the RFID traffic signs 306B are battery power assisted RFID tags, and are connected to batteries or wired into a power source. For example, the power source can be a battery, a connection into a power grid, a solar photoelectric cell, or another source of power.

In another embodiment, the RFID traffic signs 306B are active RFID tags and wired into a power source. In addition, the RFID traffic signs 306B can be wired into a wired or wireless communication network.

The automobile 300 can include a receiver 308B. The receiver 308B can be optimized to receive traffic information transmitted by the RFID traffic sign 306B. For example, the receiver 304B can be optimized to receive traffic information from a 45 degree cone in front of the moving automobile 300, where RIFD traffic signs 306B are installed. It will be appreciated that multiple receivers can be installed and optimized for receiving RFID signals.

It will be appreciated that the transmitter 304B and the receiver 308B can share an antenna. The transmitter 304B and the receiver 308B can be mounted and optimized for transmitting and receiving in a zone in front of the automobile 300. For example, the transmitter 304B and the receiver 308B can be mounted on the engine compartment hood or the front bumper. It will be appreciated that the receiver 308 can be oriented towards the front of the vehicle and situated to receive RFID signals.

It will be appreciated that the components such as the display 302, light source 304A, transmitter 304B, sensor module 308A, and receiver 308B can be integrated into the automobile 300 at time of manufacture, or later added as upgrades. In an alternative embodiment, the components can be packaged into a portable unit with an included batter for easy addition to a new vehicle. The portable unit can also be powered by the vehicle, for example, from a cigarette lighter outlet. The portable unit is easy to add to an existing vehicle, suitable for adding support for new traffic signage in existing cars.

In one embodiment, the automobile 300 can be equipped with an engine governor that prevents the automobile 300 from exceeding the posted speed limit, or some percentage over the speed limit. An automobile driver can have such a governor installed as part of an agreement with a second party, such as an insurance company providing discounted driver's insurance. In another example, an automobile driver can have an agreement with a regulating agency as a condition for operating the automobile.

For example, drivers with a short or dangerous driving history can have a conditional driver's license based on them installing an engine governor. For example, commercial drivers can be required to drive below the posted speed limit at all times.

In one embodiment, the automobile 300 can have multiple ignition keys, some of which activate the engine governor and some of which do not. For example, a guest key can be provided to guest operators such as children, valet attendants, etc. which activates the engine governor. For example, the owner key can allow the owner to activate or deactivate the engine governor.

In one embodiment, the traffic signs (either reflector or RFID or both) are installed by governmental agencies, and therefore the transmitted traffic information can be treated as more than advisory. Thus, such traffic information can be treated as reliable and up-to-date by the driver.

The traffic signs (either reflector or RFID or both) can have a mobile embodiment, such as a portable traffic sign or a traffic cone. They can be moved to a relevant location and activated to transmit high priority traffic information. For example, such mobile embodiments can be used by police to reduce the speed limit around accident scenes. For example, such mobile embodiments can be used by construction crews to reduce the speed limit around construction zones. For example, such mobile embodiments can be used when traffic conditions worsen and the speed limit must be reduced for safety.

In one embodiment, the traffic information can be fed to an on-board navigation system of the automobile 300, which can be used to reroute as necessary and better estimate a time of arrival.

In one embodiment, navigation systems can be loaded with official traffic information including applicable speed limits. Alternatively, the navigation systems can be loaded with traffic information derived from official sources, but not guaranteed to be official.

In one embodiment, for example, during a transition period when the discussed system is being implemented, official cars may include a receiver and a GPS system, and therefore build an official database of RFID tags along with associated traffic information. Combined with a database of previously installed and newly installed traffic information, the master traffic information can be available for download into navigation systems. This provides a dynamic update of traffic information feature to navigation systems.

The on-board navigation system can further include a default speed limit, defined by a local environment. For example, cities and highways can be associated with a default speed which can be displayed absent local traffic information.

The above systems can be used for various applications to improve road safety. For example, a vehicle can be equipped with electronics limiting the vehicle to the speed limit. In one example, short periods of exceeding the speed limit for safety purposes will be allowed. In one example, instances where the vehicle exceeds the speed limit can be logged and reported.

In the above example, the vehicle equipped with the appropriate electronics can qualify for lower insurance or be other deemed safer to drive. Inexperienced drivers or drivers with a dangerous driving history can be permitted to drive such vehicles.

Figure 4:
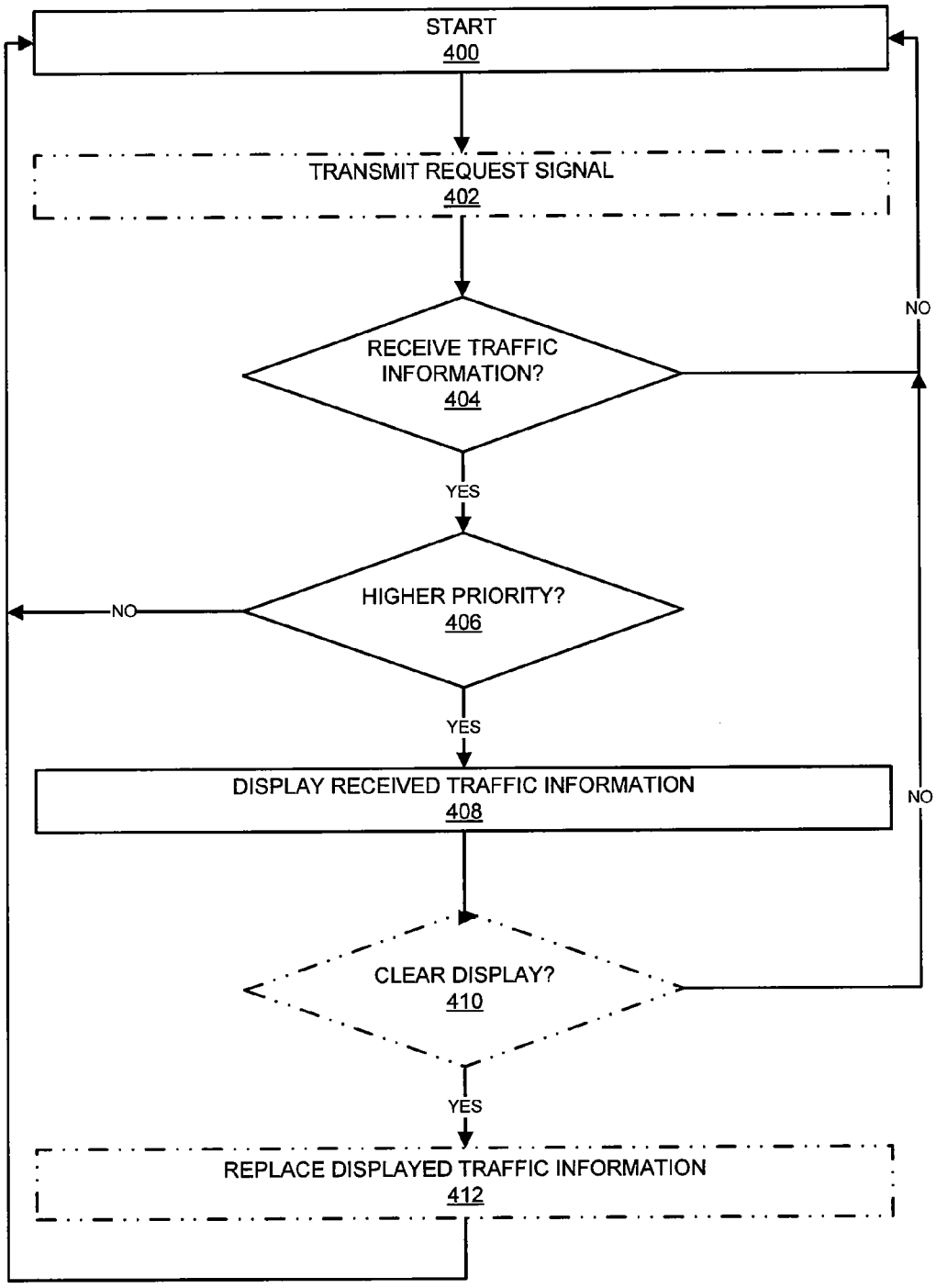
FIG. 4 illustrates an example procedure for processing received traffic information.

FIG. 4 illustrates an example procedure for processing received traffic information. The procedure can be executed by a vehicle incorporating the systems discussed above for receiving traffic information. For example, the vehicle can be a passenger automobile.

In one embodiment, the automobile includes a transmitter for transmitting a request signal to an RFID tag and a receiver for receiving an RFID response signal. It will be appreciated that the transmitter and a receiver can share an antenna module.

In another embodiment, the automobile includes a non-visible light source for projecting a non-visible light beam and a sensor module for sensing a reflected polarized reflection. It will be appreciated that the light source can be directed forward in an automobile movement direction.

The procedure starts at 400.

In 402, the automobile optionally transmits a request signal from a vehicle-mounted transmitter to a proximate RFID tag. The request signal can be transmitted continuously while the automobile is in motion or periodically. In one embodiment, the period of transmission can vary based on an automobile speed.

It will be appreciated that in a non-visible light reflection embodiment, the automobile may continuously or periodically transmit a non-visible light forward to create reflections off road reflectors.

In 404, the automobile tests whether traffic information has been received.

In one embodiment, traffic information is received at a vehicle-mounted receiver from a proximate RFID tag.

In another embodiment, traffic information is received at a vehicle-mounted sensor module from a proximate non-visible road reflector. The reflection can include polarized portions as reflected from polarized regions on the road reflector, as discussed above.

If traffic information has been received, the automobile proceeds to 406. If no traffic information has been received, the automobile can return to the start at 400.

In 406, the automobile tests whether the traffic information received above has a higher priority than a displayed traffic information. As discussed above, the automobile can constantly display the last received traffic information, if relevant. Regular priority traffic information can be, for example, posted speed limits along a road. High priority traffic information can be a temporary speed limit posted along a road, for example, in a construction zone.

If the received traffic information has a higher priority, the automobile proceeds to 408. If the received traffic information does not have a higher priority, the automobile returns to 400.

In 408, the higher priority traffic information will replace a displayed traffic information. For example, high priority traffic information can be associated with a window of existence, such as a distance or a time. In this example, once the window has elapsed, the vehicle-mounted display can revert to a previously displayed information.

In one embodiment, equal priority traffic information will also replace a displayed traffic information. For example, the posted speed limits can change along a road, and each posted speed limit can have regular priority. In this manner, the displayed speed limit is constantly updated with the latest received speed limit.

In 410, the automobile can optionally test whether the display should be cleared. As discussed above, received traffic information can include an associated window of existence. Once the window has elapsed, the associated traffic information should no longer be displayed.

If the display should be cleared, the automobile proceeds to 412. If the display should not be cleared, the automobile proceeds to 400.

In 412, the automobile optionally replaces the displayed traffic information. For example, the automobile can check whether a previously received traffic information is still within its associated window of existence and display it. If no valid traffic information is available, the display may remain clear until the next received traffic information is processed by the automobile.

Figure 5:
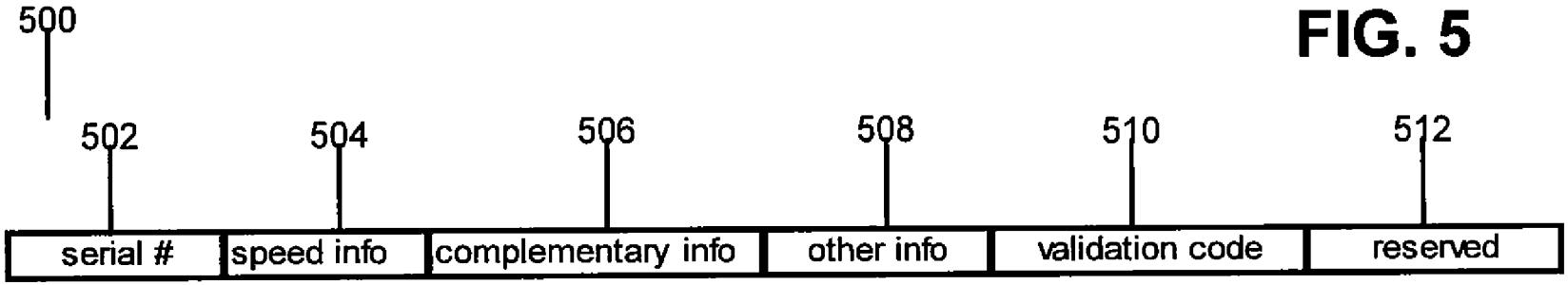
FIG. 5 illustrates an example data structure used in an RFID communication protocol.

FIG. 5 illustrates an example data structure used in an RFID communication protocol. Traffic information transmitted from an RFID tag to a reader, as discussed, can use data structure 500, discussed below.

The data structure 500 can include a serial number 502. The serial number 502 can be unique across the traffic information system or otherwise identify a specific RFID tag. For example, the serial number 502 can be associated with origin information such as a RFID tag manufacturer, a date of manufacturer, and intended use market. Intended use market information can include country, units used, traffic zone (like city, suburb, country highway, freeway, etc.). The serial number 502 can be further associated with a traffic information type (e.g., static or dynamic), RFID type (active, passive, semi-active, etc.). It will be appreciated that the associated information can be stored in an accessible data store, or in the RFID tag for transmission to the reader.

It will be appreciated that some of the above information may be readable or accessible by special readers, such as those used for administration and management of traffic signage. Such special readers can be configured to automatically log and map the current network of tags, and display the compiled map to a user.

The data structure 500 can include a speed information 504. For example, the speed information 504 can be a short text string specifying a speed limit and a condition of the speed, i.e.: for next curve, for the next 2 miles, when lights flashing, if foggy or raining, if rain, when towing, etc.

Alternatively, the speed information 504 can be an identifier for use in a look up table instead of text. Such identifiers would be useful to transmit speed limit information in a very concise manner. For example, two bits would allow the transfer of four separate identifiers, corresponding to conditions 1, 2, 3, and 4. Readers would include a look up table that associates the conditions to speed limits or other traffic information.

It will be appreciated that the look up table can be environment-dependent. Freeways can have a different look up table than a city road. Similarly, different classes of vehicles, such as motorcycles, sedans, and trucks, can have different look up tables installed.

The data structure 500 can include complementary information 506. For example, complementary information 506 can include applicable minimum speed, wind cautions, and temporary warning information provided from dynamic tags.

The data structure 500 can include other information 508. Other information 508 can include priority information of the associated traffic information. Dynamic tags can be updated to transmit accident and safety notices. It will be appreciated that embodiments of the dynamic tags can be installed in police, ambulance and other official vehicles to broadcast safety information.

The data structure 500 can include a validation code 510. Various systems can be used to ensure data integrity of the data transmitted by the RFID tags. For example, a cyclic redundancy check (CRC) or other hash function can be used to compute a validation code 510 from the data for transmission along with the data. The reader computes its own validation code from the data and verifies its code is equal to the validation code 510. It will be appreciated that other validation schemes can be used.

The data structure 500 can include a reserved section 512 for future expansion.

As discussed above, one example embodiment of the present invention can be a traffic sign. The traffic sign can include an RFID tag configured to transmit a traffic information to a vehicle-mounted receiver. The traffic information can be associated with a priority. The receiver can be in communication with a vehicle-mounted display, wherein the display displays information selected from received traffic information based on priority, time of receipt, and relevance. The traffic information can be a speed limit associated with a portion of road. The RFID tag can include a toggle that toggles between a plurality of pre-defined traffic information to transmit. The traffic information can be removed from the vehicle-mounted display after at least one of: passage of a specified period of time, passage of a specified distance by the receiver, and receipt of a higher priority traffic information. The traffic sign can be portable and the traffic information is associated with a high priority for overriding previously received traffic information displayed by the display. The traffic sign can include a visible portion conveying the traffic information visible to a driver of a vehicle. The RFID tag can be at least one of: a passive RFID tag, an active RFID tag, and a battery-assisted RFID tag.

Another example embodiment of the present invention can be a traffic sign. The traffic sign can include a polarized road reflector configured to reflect non-visible light to a vehicle-mounted sensor module. The polarization of the road reflector can convey traffic information. The sensor module can be in communication with a vehicle-mounted display, wherein the display displays information selected from received traffic information based on time of receipt, and relevance. The polarization of the road reflector can convey a binary word. The binary word can be converted to the traffic information by the sensor module via a look-up table. The road reflector can reflect non-visible light projected by a vehicle-mounted light source. The traffic information can be associated with a priority, and the display further selects information for display based on priority. The traffic information can be a speed limit associated with a portion of road. The traffic information can be removed from the display after at least one of: passage of a specified period of time, passage of a specified distance by the sensor, and receipt of a higher priority traffic information. The traffic sign can be portable and the traffic information is associated with a high priority overriding previously received traffic information displayed by the vehicle-mounted display. The traffic sign can include a visible portion conveying the traffic information visible to a driver of a vehicle.

Another example embodiment of the present invention can be a method. The method can include transmitting a request signal to a proximate RFID tag. The method can include receiving a response signal from the proximate RFID tag responsive to the request signal. The method can include parsing the response signal into a traffic information and a priority. The method can include displaying the traffic information based on, in part, the priority, a time of receipt, and relevance. The RFID tag can include a toggle configured to select the traffic information to transmit from a set of available traffic information.

Another example embodiment of the present invention can be a method. The method can include sensing a polarized reflection from a proximate polarized road reflector, wherein the polarization of the reflector conveys traffic information. The method can include parsing the polarized reflection into a traffic information. The method can include displaying the traffic information based on, in part, a time of receipt and relevance. The method can include transmitting a non-visible light.

Another example embodiment of the present invention can be an apparatus. The apparatus can include an RFID receiver module configured to receive a traffic information from a nearby RFID tag, wherein the traffic information is associated with a priority. The apparatus can include a display in communication with the RFID receiver module, wherein the display displays information selected from the received traffic information based on priority, time of receipt, and relevance to a driver. The apparatus can include a location module for determining a current location, wherein the displayed information further depends on the current location. The traffic information can be a speed limit associated with a portion of road. The traffic information can be removed from the display after at least one of: passage of a specified period of time, passage of a specified distance by the receiver, and receipt of a higher priority traffic information. The RFID receiver module can be mounted to a vehicle chassis and the display is integrated into a vehicle dashboard. The apparatus can include a battery for powering the RFID receiver module and the display, wherein the RFID receiver module, the display, and the battery are contained in a portable package.

Another example embodiment of the present invention can be an apparatus. The apparatus can include a sensor module for detecting non-visible light reflected from a polarized road reflector, wherein the polarization of the road reflector conveys traffic information. The apparatus can include a display is communication with the sensor module, wherein the display displays information selected from received traffic information based on time of receipt, and relevance. The polarization of the road reflector can convey a binary word. The binary word can be converted to the traffic information by the sensor module via a look-up table accessible to the display. The traffic information can be associated with a priority, and the display further selects information for display based on priority. The traffic information can be a speed limit associated with a portion of road. The traffic information can be removed from the display after at least one of: passage of a specified period of time, passage of a specified distance by the sensor, and receipt of a higher priority traffic information. The sensor module can be mounted to a vehicle chassis and the display is integrated into a vehicle dashboard. The apparatus can include a non-visible light source for projecting the non-visible light. The apparatus can include a battery for powering the non-visible light source, the sensor module and the display, wherein the non-visible light source, the sensor module, the display, and the battery are contained in a portable package.

Another example embodiment of the present invention can be a method. The method can include receiving a traffic information transmitted from an RFID tag. The method can include verifying an integrity of the traffic information by executing a validation routine on the traffic information. The method can include parsing the traffic information, wherein the traffic information includes an applicable speed limit. The method can include displaying the traffic information to a driver of a vehicle. The traffic information can be received responsive to transmitting a receiver request. The validation routine can be a cyclic redundancy check. The method can include transmitting an authentication code and a request for traffic management information. The method can include receiving a traffic management information transmitted from the RFID tag. The traffic information can include a look up table entry identifier and parsing the traffic information further includes, reading the applicable speed limit from the look up table entry associated with the identifier.

The specific embodiments described in this document represent examples or embodiments of the present invention, and are illustrative in nature rather than restrictive. In the above description, for purposes of explanation, numerous specific details are set forth in order to provide a thorough understanding of the invention. It will be apparent, however, to one skilled in the art that the invention can be practiced without these specific details.

Reference in the specification to "one embodiment" or "an embodiment" or "some embodiments" means that a particular feature, structure, or characteristic described in connection with the embodiment is included in at least one embodiment of the present invention. Features and aspects of various embodiments may be integrated into other embodiments, and embodiments illustrated in this document may be implemented without all of the features or aspects illustrated or described. It will be appreciated to those skilled in the art that the preceding examples and embodiments are exemplary and not limiting.

While the system, apparatus and method have been described in terms of what are presently considered to be the most practical and effective embodiments, it is to be understood that the disclosure need not be limited to the disclosed embodiments. It is intended that all permutations, enhancements, equivalents, combinations, and improvements thereto that are apparent to those skilled in the art upon a reading of the specification and a study of the drawings are included within the true spirit and scope of the present invention. The scope of the disclosure should thus be accorded the broadest interpretation so as to encompass all such modifications and similar structures. It is therefore intended that the application includes all such modifications, permutations and equivalents that fall within the true spirit and scope of the present invention.

What is claimed is:

1. A traffic sign, comprising:

a polarized road reflector configured to reflect non-visible light to a vehicle-mounted sensor module, wherein the polarization of the road reflector conveys traffic information, and the sensor module is in communication with a vehicle-mounted display, wherein the display displays information selected from received traffic information based on time of receipt, and relevance.

2. The traffic sign of claim 1, wherein the polarization of the road reflector conveys a binary word.

3. The traffic sign of claim 2, wherein the binary word is converted to the traffic information by the sensor module via a look-up table accessible to the vehicle-mounted display.

4. The traffic sign of claim 1, wherein the road reflector reflects non-visible light projected by a vehicle-mounted light source.

5. The traffic sign of claim 1, wherein the traffic information is associated with a priority, and the display further selects information for display based on priority.

6. The traffic sign of claim 1, wherein the traffic information is a speed limit associated with a portion of road.

7. The traffic sign of claim 6, wherein the traffic information is removed from the display after at least one of: passage of a specified period of time, passage of a specified distance by the sensor, and receipt of a higher priority traffic information.

8. The traffic sign of claim 1, wherein the traffic sign is portable and the traffic information is associated with a high priority overriding previously received traffic information displayed by the vehicle-mounted display.

9. The traffic sign of claim 1, further comprising:

a visible portion conveying the traffic information visible to a driver of a vehicle.

10. A method, comprising:

sensing a polarized reflection from a proximate polarized road reflector, wherein the polarization of the reflector conveys traffic information;

parsing the polarized reflection into a traffic information;

displaying the traffic information based on, in part, a time of receipt and relevance.

11. The method of 10, further comprising:

transmitting a non-visible light.

12. An apparatus, comprising:

a sensor module for detecting non-visible light reflected from a polarized road reflector, wherein the polarization of the road reflector conveys traffic information;

a display is communication with the sensor module, wherein the display displays information selected from received traffic information based on time of receipt, and relevance.

13. The apparatus of claim 12, wherein the polarization of the road reflector conveys a binary word.

14. The apparatus of claim 13, wherein the binary word is converted to the traffic information by the sensor module via a look-up table accessible to the display.

15. The apparatus of claim 12, wherein the traffic information is associated with a priority, and the display further selects information for display based on priority.

16. The apparatus of claim 12, wherein the traffic information is a speed limit associated with a portion of road.

17. The apparatus of claim 16, wherein the traffic information is removed from the display after at least one of: passage of a specified period of time, passage of a specified distance by the sensor, and receipt of a higher priority traffic information.

18. The apparatus of claim 12, wherein the sensor module is mounted to a vehicle chassis and the display is integrated into a vehicle dashboard.

19. The apparatus of claim 12, further comprising:

a non-visible light source for projecting the non-visible light;

a battery for powering the non-visible light source, the sensor module and the display, wherein the non-visible light source, the sensor module, the display, and the battery are contained in a portable package.

20. A method, comprising:

receiving a traffic information transmitted from an RFID tag;

verifying an integrity of the traffic information by executing a validation routine on the traffic information;

parsing the traffic information, wherein the traffic information includes an applicable speed limit;

displaying the traffic information to a driver of a vehicle.

21. The method of claim 20, wherein the traffic information is received responsive to transmitting a receiver request.

22. The method of claim 20, wherein the validation routine is a cyclic redundancy check.

23. The method of claim 20, further comprising:

transmitting an authentication code and a request for traffic management information;

receiving a traffic management information transmitted from the RFID tag.

24. The method of claim 20, wherein the traffic information includes a look up table entry identifier and parsing the traffic information further includes, reading the applicable speed limit from the look up table entry associated with the identifier.

* * * * *